US005605166A

United States Patent [19]

Chou

[11] Patent Number: 5,605,166

[45] Date of Patent: Feb. 25, 1997

[54] HAIR CLIP

[76] Inventor: Kuo-Hua Chou, No. 17, Alley 10, Lane 118, Su-Wei Rd., Wu-Ku Hsiang, Taipei County, Taiwan

[21] Appl. No.: 556,652

[22] Filed: Nov. 13, 1995

[51] Int. Cl.[6] ..... A45D 8/22; A45D 8/28

[52] U.S. Cl. ..... 132/279; 132/278; 132/275; 132/276; 132/277

[58] Field of Search ..... 132/273, 275, 132/276, 277, 278, 279, 120; D28/39, 40, 41, 42; 24/530, 562, 458, 545

[56] References Cited

U.S. PATENT DOCUMENTS

| | | | |
|---|---|---|---|
| 4,991,607 | 2/1991 | Chou | 132/279 |
| 5,323,793 | 6/1994 | Lorenzi | 132/279 |
| 5,495,862 | 3/1996 | Dewing | 132/278 |
| 5,537,724 | 7/1996 | Chou | 132/279 |

*Primary Examiner*—Gene Mancene

*Assistant Examiner*—Pedro Philogene

*Attorney, Agent, or Firm*—Morton J. Rosenberg; David I. Klein

[57] ABSTRACT

A hair clip which includes a base plate, which has a center opening, two retaining notches at two opposite ends of the center opening, a plurality of downward teeth around the center opening, a pair of first downward lugs, a pair of second downward lugs, and two inward retainer rods raised from one first downward lug at different elevations, an ornament plate covered on the center opening of the base plate and having two downward retainer rods respectively fastened to the retaining notches, and a clamping plate, which has a coupling portion at one end pivoted to the second downward lugs of the base by a pivot, a retaining loop at an opposite end for fastening to one inward retainer rod of the base plate, a raised portion at one side corresponding to the center opening of the base plate, and a plurality of teeth raised from the raised portions for holding down the hair when the clamping plate is closed, or for grooming the hair when the clamping plate is opened.

3 Claims, 9 Drawing Sheets

HAIR CLIP

BACKGROUND OF THE INVENTION

The present invention relates to hair clips, and relates more particularly to such a hair clip which can be used as an implement for grooming the hair when it is unfastened.

FIG. 10 shows a hair clip according to the prior art. This structure of hair clip comprises a substantially arched ornament plate 5, a mounting plate 51 adhered to the ornament plate 5 at an inner side, an arched spring plate 52 having two opposite ends fixedly secured to the mounting plate 51, two springy retainer rods 54 intersected at one end of the arched spring plate 52, and a clamping spring leaf 53 having a fixed end hinged to one end of the arched spring plate 52 remote from the springy retainer rods 54 and a free end made with a coupling portion 55 for connection to the springy retainer rods 54. Because the ornament plate 5 is fixed to the mounting frame 51, it is not changeable. In order to decorate a different hair style, a different hair clip may have to be used. Furthermore, when coupling portion 55 of the clamping spring leaf 53 is fastened to the springy retainer rods 54, the hair tends to be damaged by the arched spring plate 52 and the clamping spring leaf 53.

SUMMARY OF THE INVENTION

The present invention has been accomplished to provide a hair clip which eliminates the aforesaid drawbacks.

According to one embodiment of the present invention, the hair clip comprises a base plate, which has a center opening, two retaining notches at two opposite ends of the center opening, a plurality of downward teeth around the center opening, a pair of first downward lugs, a pair of second downward lugs, and two inward retainer rods raised from one first downward lug at different elevations, an ornament plate covered on the center opening of the base plate and having two downward retainer rods respectively fastened to the retaining notches, and a clamping plate, which has a coupling portion at one end pivoted to the second downward lugs of the base by a pivot, a retaining loop at an opposite end for fastening to one inward retainer rod of the base plate, a raised portion at one side corresponding to the center opening of the base plate, and a plurality of teeth raised from the raised portions for holding down the hair when the clamping plate is closed, or for grooming the hair when the clamping plate is opened.

According to an alternate form of the present invention, the clamping plate has a corrugated, raised portion at the top side for fitting into the center opening of the base plate to hold down the hair.

DETAILED DESCRIPTION OF THE PREFERRED EMBODIMENTS

Figure 1:
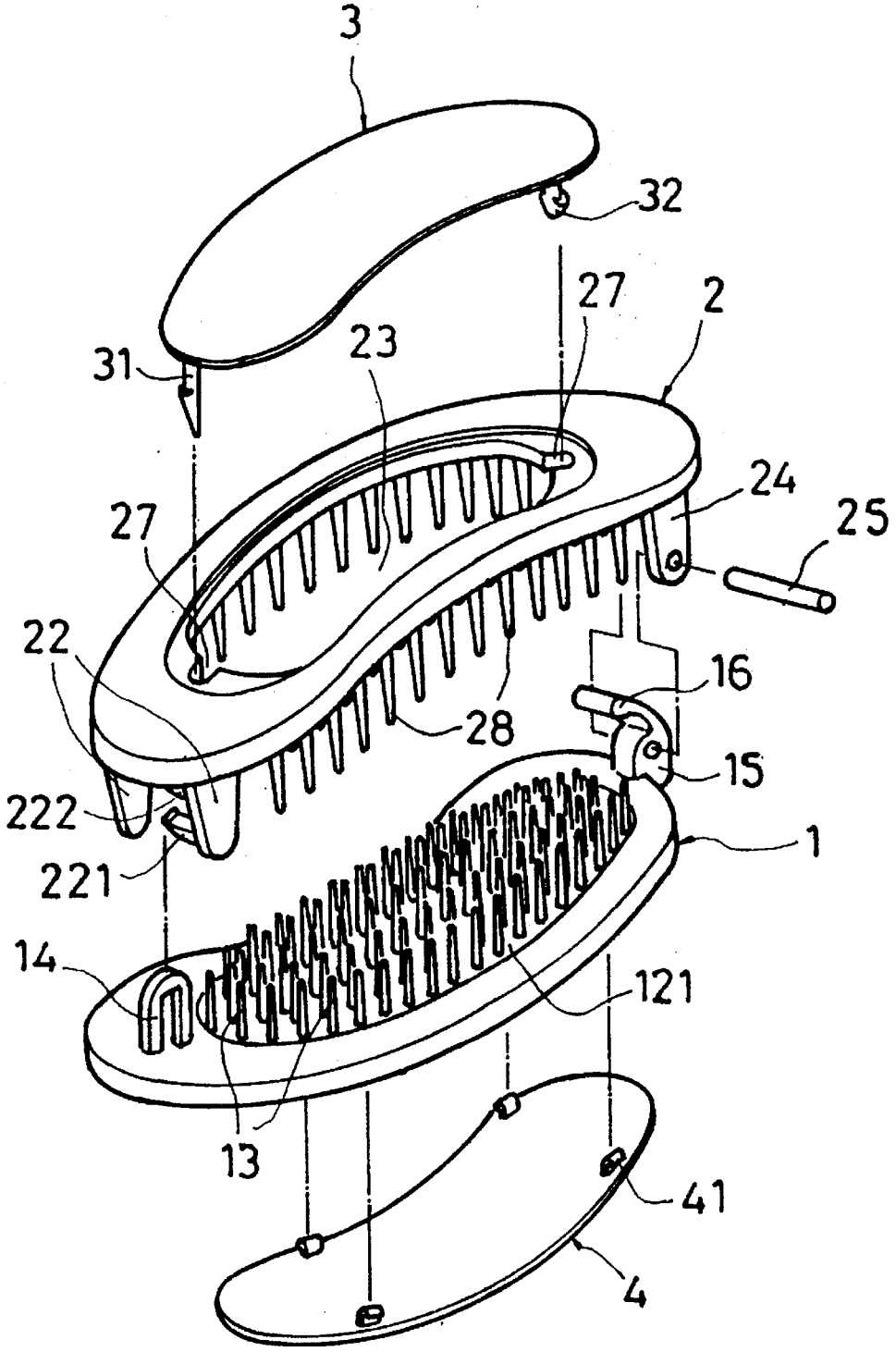
FIG. 1 is an exploded view of a hair clip according to one embodiment of the present invention.

Referring to Figures from 1 to 6, a hair clip in accordance with the present invention is generally comprised of a substantially arched base plate 2 and a clamping plate 1. The base plate 2 comprises an elongated, curved, center opening 23, two retaining notches 27 at two opposite ends of the center opening 23, a plurality of teeth 28 perpendicularly raised from the bottom side around the center opening 23, a pair of first downward lugs 22 disposed at one end in a parallel relation, two inward retainer rods 221 and 222 raised from one first downward lug 22 at different elevations, a pair of second downward lugs 24 disposed at an opposite ends, a stop block 26 disposed adjacent to the second downward lugs 24. The clamping plate 1 comprises a coupling portion 15 at one end pivotably connected between the second downward lugs 24 by a pivot 25, a springy pressure rod 16 extending from the coupling portion 15 for acting against the stop block 26 of the base plate 2 for permitting the clamping plate 1 to be retained to the base plate 2 in an open status, a retaining loop 14 at an opposite end for fastening to one inward retainer rod 221 or 222, a raised portion 121 corresponding to the center opening 23 of the base plate 2, a plurality of teeth 13 raised from the raised portion 121 for holding down the hair, a back recess 1211, and a cover board 4 covered on the back recess 1211. When the retaining loop 14 of the clamping plate 1 is disconnected from the pair of first downward lugs 22, the base plate 1 can be used as a brush for arranging the hair. The cover board 4 has hooks 41 for fastening to the back recess 1211 of the clamping plate 1. An ornament plate 3 is covered on the center opening 23 of the base plate 2, having a first downward retainer rod 31 and a second downward retainer rod 32 at two opposite ends respectively fastened to the retaining notches 27 of the base plate 2.

Figure 2:
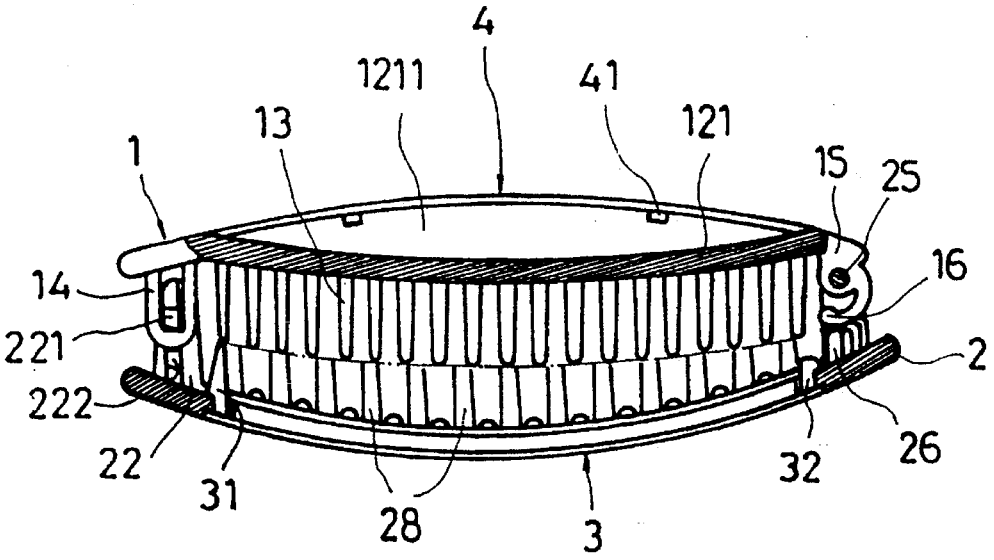
FIG. 2 is a sectional assembly view of the hair clip shown in FIG. 1.
Figure 3:
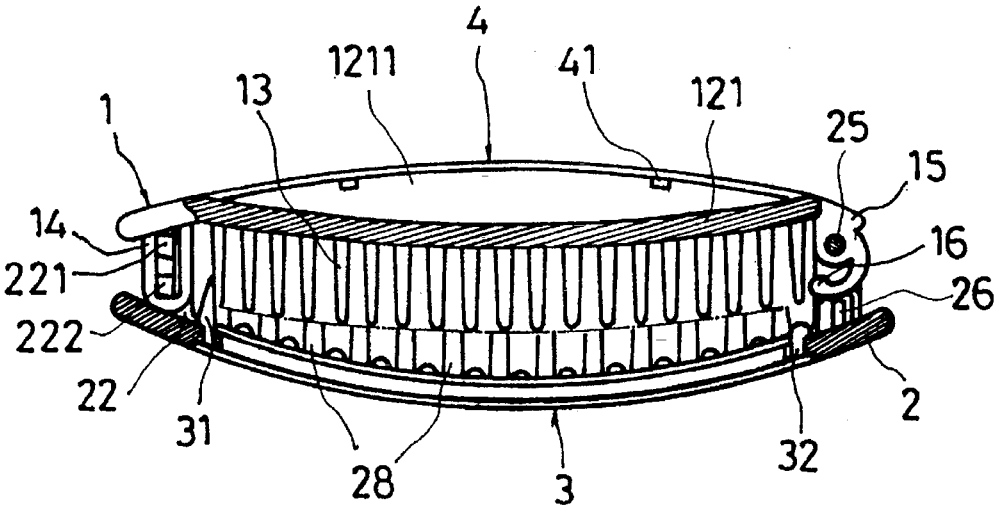
FIG. 3 is similar to FIG. 2 but showing the retaining loop of the clamping plate fastened to the other retainer rod of the base plate.

Referring to FIGS. 2 and 3, the retaining loop 14 of the clamping plate 1 can be fastened to either of the two inward retainer rods 221 and 222 subject to the thickness of the hair retained between the clamping plate 1 and the base plate 2.

Figure 4A:
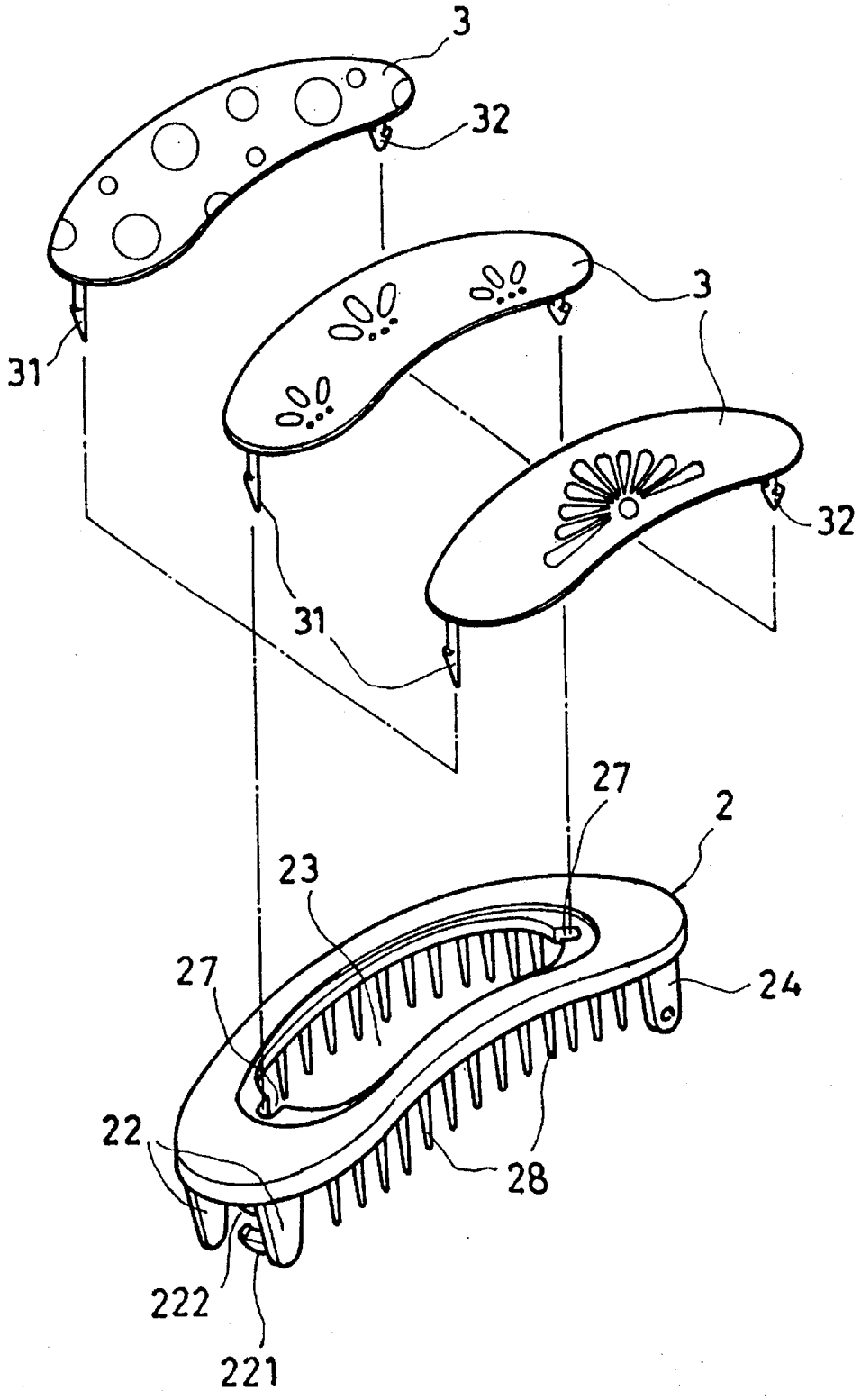
FIG. 4A shows different forms of the ornament plate according to the present invention.

Referring to FIG. 4A, the ornament plate 3 can be made in any of a variety of colors, patterns, or shapes, having a first downward retainer rod 31 and a second downward retainer rod 32 at two opposite ends respectively fastened to the retaining notches 27 of the base plate 2.

Figure 4B:
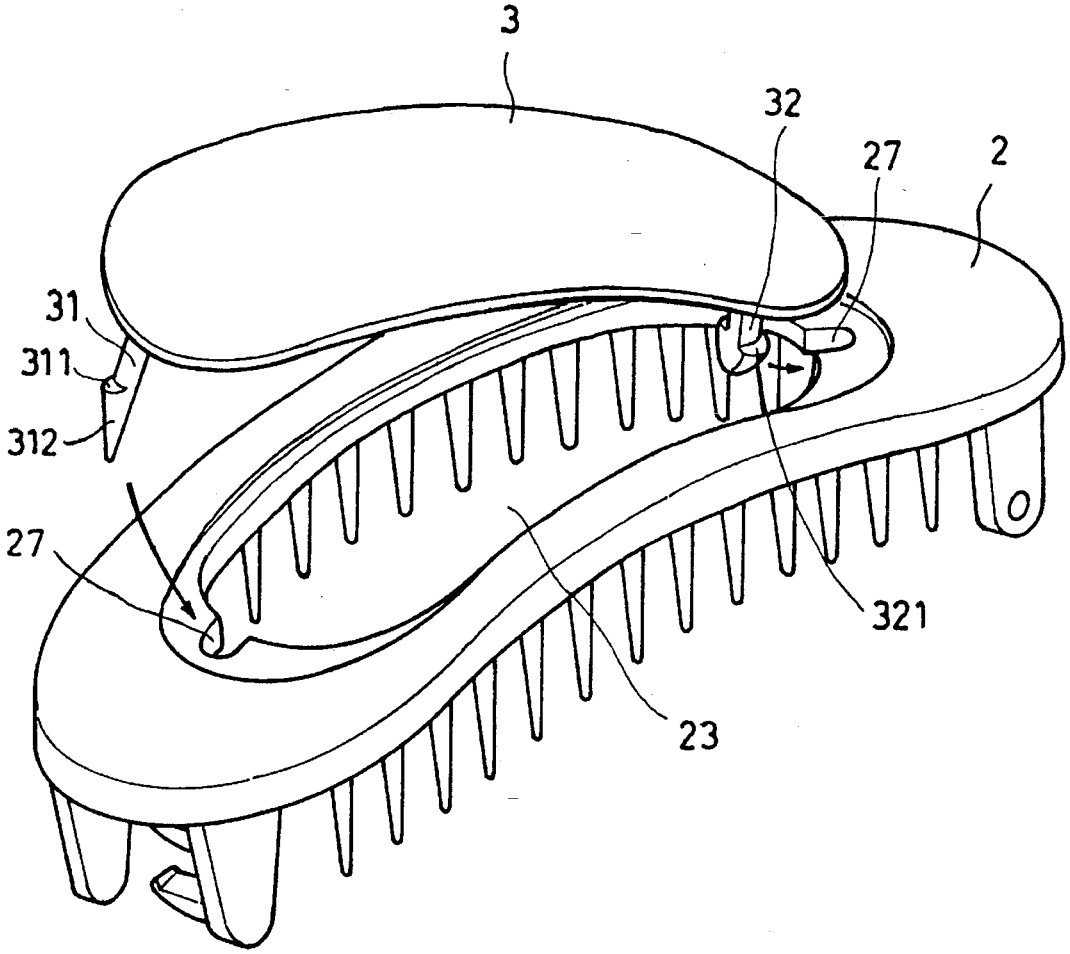
FIG. 4B shows the connection between the ornament plate and the base plate according to the present invention.
Figure 5:
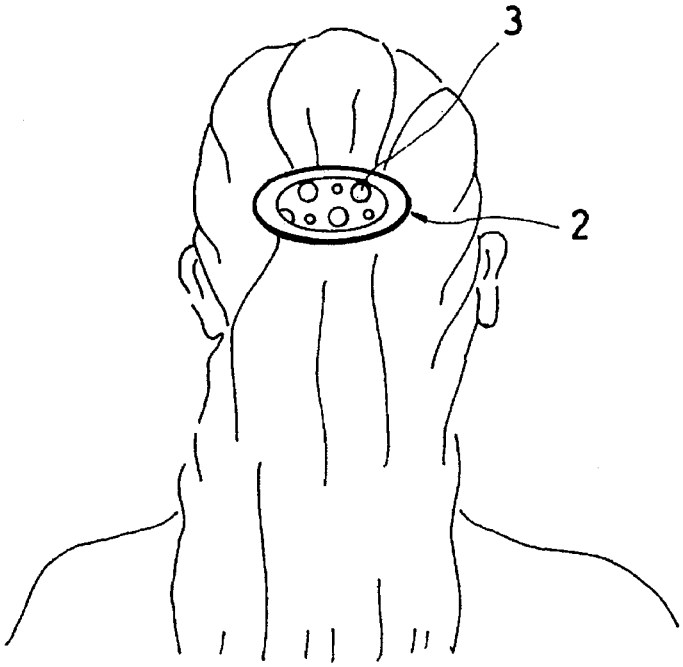
FIG. 5 shows an application example of the present invention.
Figure 6:
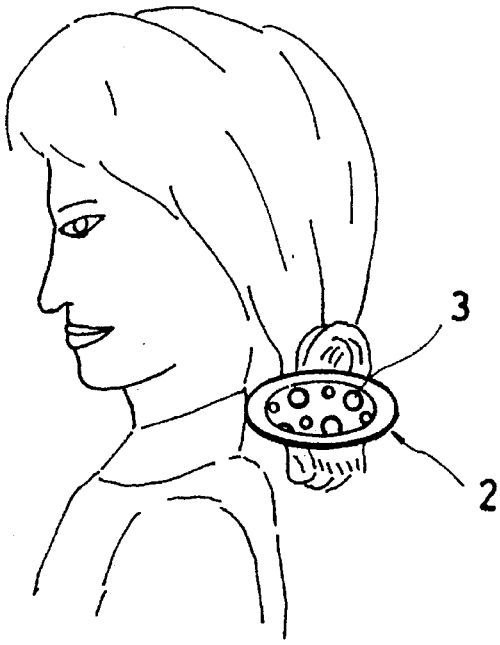
FIG. 6 shows another application example of the present invention.

Referring to FIG. 4B, the first downward retainer rod 31 of the ornament plate 3 has a front slope 312 and a stop edge 311 at the top of the front slope 312; the second downward retainer rod 32 of the ornament plate has an arrowhead-like hooked portion 321. When the arrowhead-like hooked portion 321 of the second downward retainer rod 32 is hooked on one retaining notch 27 of the base plate 2, the front slope 312 of the first downward retainer rod 31 is forced into the other retaining notch 27 of the base plate 2, permitting the stop edge 311 to be engaged with the bottom side of the base plate 2.

Figure 7:
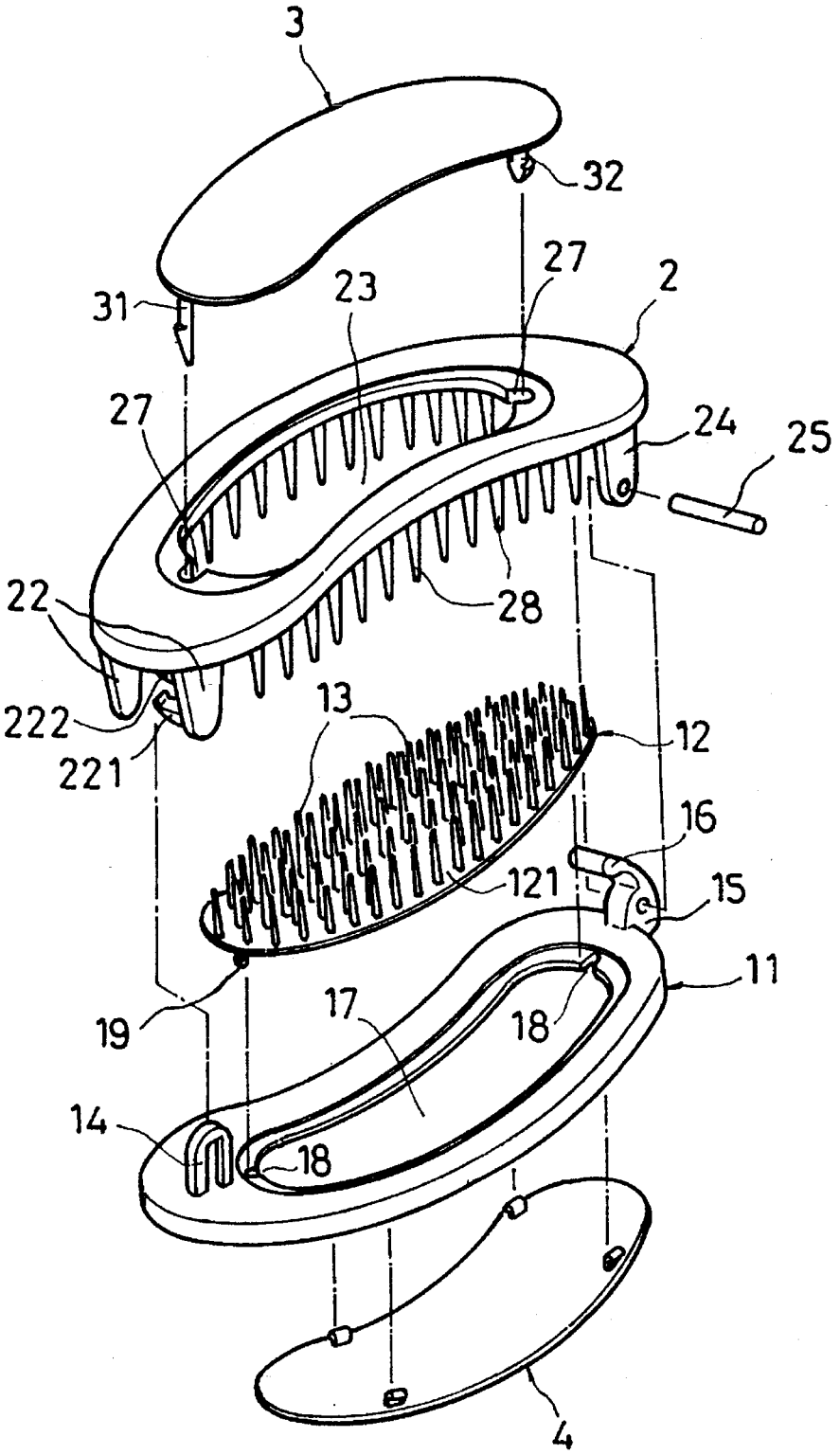
FIG. 7 is an exploded view of a hair clip according to a second embodiment of the present invention.

FIG. 7 is an exploded view of a hair clip according to a second embodiment of the present invention, in which the clamping plate 11 has an elongated, curved, center opening 17, and two retaining notches 18 at two opposite ends of the center opening 17; a brush member 12 is fastened to the center opening 17 of the clamping plate 11, comprising a base (the aforesaid raised portion) 121, a plurality of teeth 13 raised from the top side of the base 121, and two downward retainer rods 19 raised from the bottom side of the base 121 and respectively fastened to the retaining notches 18.

Figure 8:
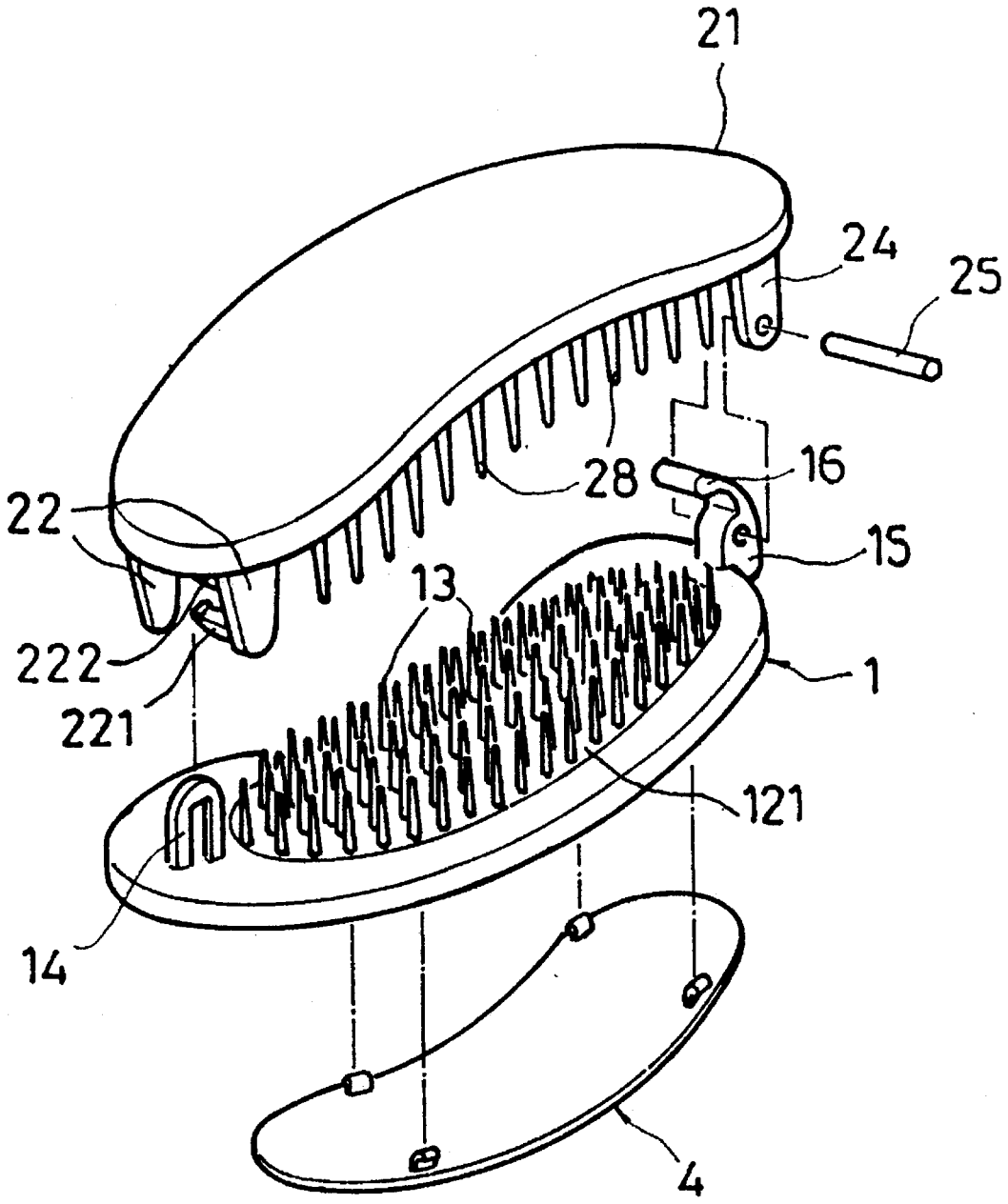
FIG. 8 is an exploded view of a hair clip according to a third embodiment of the present invention.

FIG. 8 is an exploded view of a hair clip according to a third embodiment of the present invention, in which the base plate 21 is a solid plate which eliminates the center opening 23 of the base plate 2 shown in FIG. 1 or 7.

Figure 9:
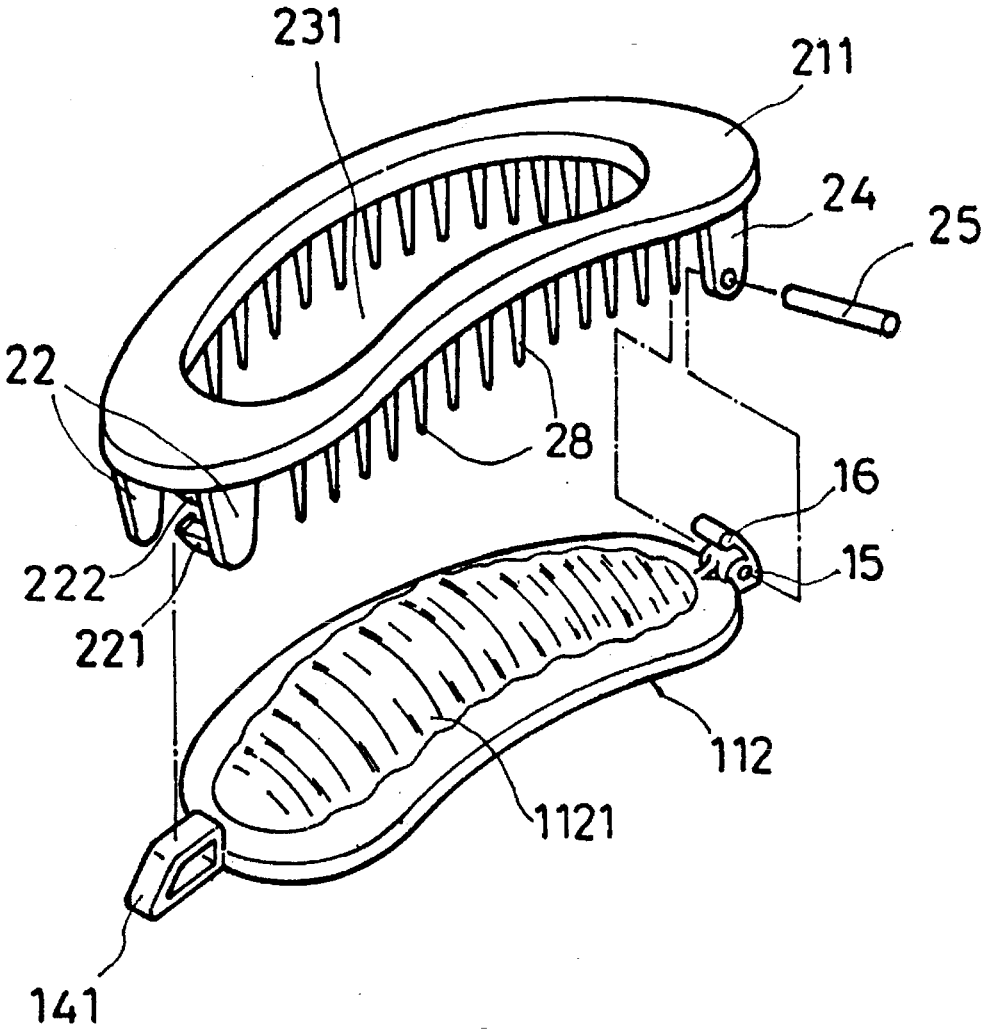
FIG. 9 is an exploded view of a hair clip according to a fourth embodiment of the present invention.
Figure 10:
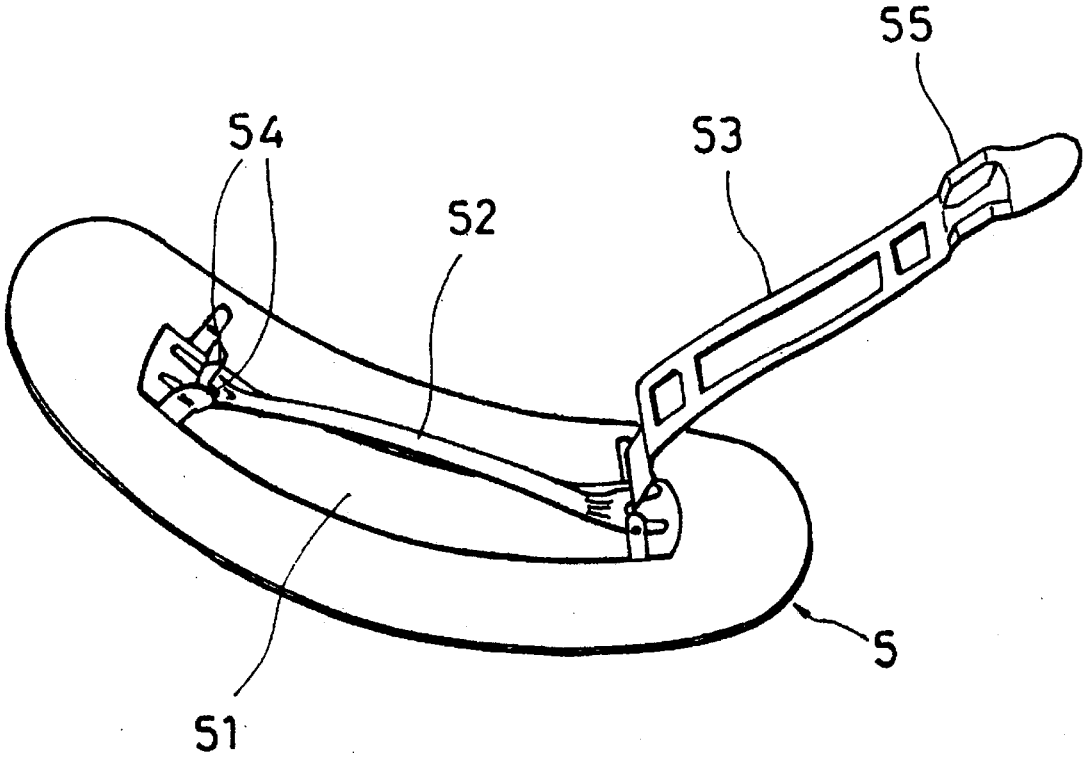
FIG.10 PRIOR ART
FIG. 10 shows a hair clip according to the prior art.

FIG. 9 is an exploded view of a hair clip according to a fourth embodiment of the present invention, the clamping plate, referenced by 112, has a corrugated portion 1121 raised from the top side for fitting into the center opening 231 of the base plate, referenced by 211.

It is to be understood that the drawings are designed for purposes of illustration only, and are not intended as a definition of the limits and scope of the invention disclosed.

I claim:

1. A hair clip comprising:

a base plate having an elongated, curved, center opening, a first retaining notch and a second retaining notch at two opposite ends of said center opening, a plurality of downward teeth raised from a bottom side thereof around said center opening, a pair of first downward lugs disposed at one end in a parallel relation, two inward retainer rods raised from one first downward lug at different elevations, a pair of second downward lugs disposed at an opposite ends, a stop block disposed adjacent to said second downward lugs;

an ornament plate fastened to said base plate and covering said center opening, said ornament plate having a first downward retainer rod and a second downward retainer rod respectively fastened to the first and second retaining notches of said base plate; and a clamping plate having a coupling portion at one end pivotably connected between said second downward lugs of said base plate by a pivot, a springy pressure rod extending from said coupling portion for acting against said stop block of said base plate for permitting said clamping plate retained to said base plate in an open status, a retaining loop at an opposite end for fastening to one inward retainer rod of said base plate, a raised portion at one side corresponding to the center opening of said base plate, a back recess at an opposite side, and a cover board covering said back recess, said cover board having a plurality of hooks respectively hooked on said back recess.

2. The hair clip of claim 1 wherein said clamping plate further comprises a plurality of teeth raised from the raised portion.

3. The hair clip of claim 1 wherein the first downward retainer rod of said ornament plate has a front slope forced into said first retaining notch of said base plate, and a stop edge disposed at a top end of said front slope and engaged with a bottom wall of said base plate; the second downward retainer rod of said ornament plate has an arrowhead-shaped hooked portion hooked in said second retaining notch of said base plate.

* * * * *